United States Patent [19]

Schweitzer

[11] 4,063,333

[45] Dec. 20, 1977

[54] CLOTHESPIN

[76] Inventor: Russell A. Schweitzer, 17639 Dwyer, Detroit, Mich. 48212

[21] Appl. No.: 742,876

[22] Filed: Nov. 18, 1976

[51] Int. Cl.[2] ..... A44G 21/00

[52] U.S. Cl. ..... 24/137 A

[58] Field of Search ..... 24/137 A, 253

[56] References Cited

U.S. PATENT DOCUMENTS

| | | | |
|---|---|---|---|
| 140,659 | 7/1873 | Tunstill | 24/137 A |
| 1,132,170 | 3/1915 | Dewinsky | 24/137 A |
| 1,810,304 | 6/1931 | Tangen | 24/253 |
| 1,874,871 | 8/1932 | Bower | 24/137 A |
| 2,248,287 | 7/1941 | Schirmer | 24/253 |
| 2,409,379 | 10/1946 | Mosaly | 24/253 |

FOREIGN PATENT DOCUMENTS

| | | | |
|---|---|---|---|
| 151,856 | 6/1953 | Australia | 24/137 A |
| 1,025,202 | 4/1953 | France | 24/137 A |
| 836,490 | 4/1952 | Germany | 24/137 A |
| 731,906 | 6/1955 | United Kingdom | 24/137 A |

*Primary Examiner*—Bernard A. Gelak
*Attorney, Agent, or Firm*—Charles P. Padgett, Jr.

[57] ABSTRACT

A highly stable clothespin of the type having a pair of elongated clamping members and a helical metal spring interposed therebetween is provided. Each of the pair of clamping members has a forward clamping jaw, a tail, and an intermediate portion. The hollow body of the helical spring serves as a fulcrum about which the intermediate portions of the elongated clamping members are pivoted for opening and closing the jaws with respect to one another for gripping articles inserted therebetween. In a first embodiment, the improved stability is achieved by providing a lateral recess about the top surface and sides of each of the clamping members adjacent the fulcrum. An integral clip formed into a rectangular configuration is provided for each of the lateral recesses and the two ends of each of the clips are inserted into the hollow body of the spring for securing the clamping members thereto. In a second embodiment, the improved stability is achieved by providing one or more pairs of elongated pin and aperture combinations disposed between the fulcrum and the clamping jaws. The tip of the non-metallic pin is disposed adjacent its corresponding aperture when the jaws are open and is telescopically received therein when the jaws are closed thereby preventing the article inserted between the jaws from contacting the metal spring while simultaneously reducing the tendency of the members to separate from the spring under abnormal conditions.

5 Claims, 10 Drawing Figures

FIG. 3
FIG. 1
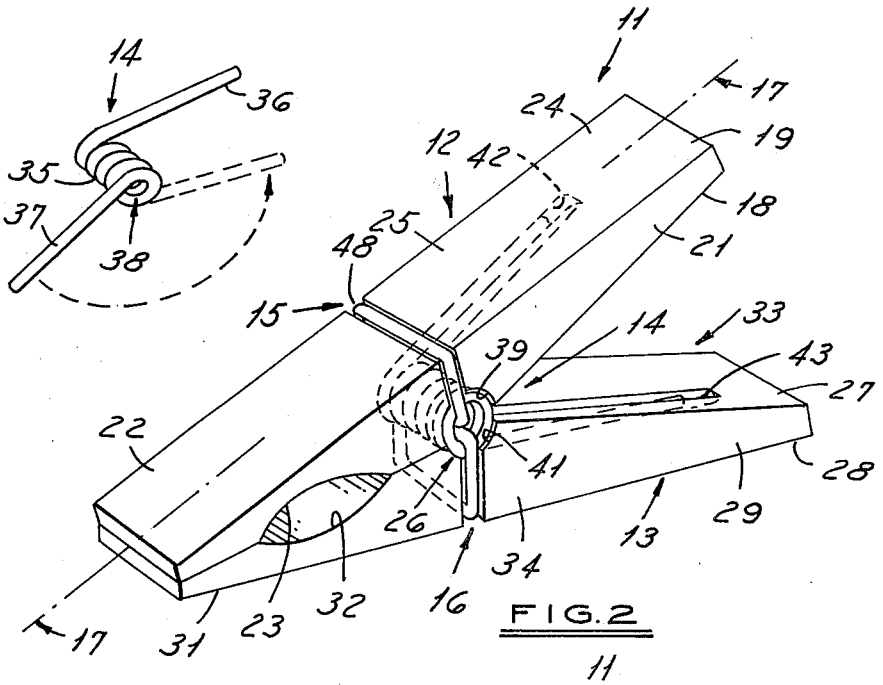
FIG. 2
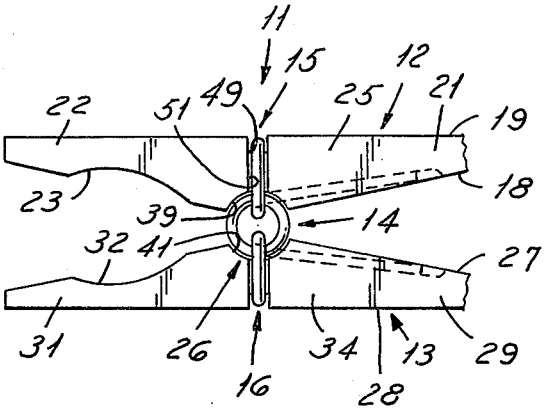
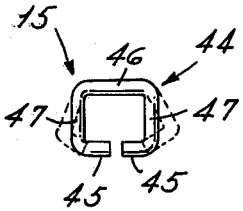
FIG. 4
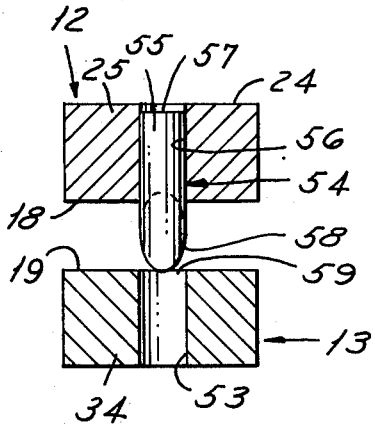
FIG. 6
FIG. 5
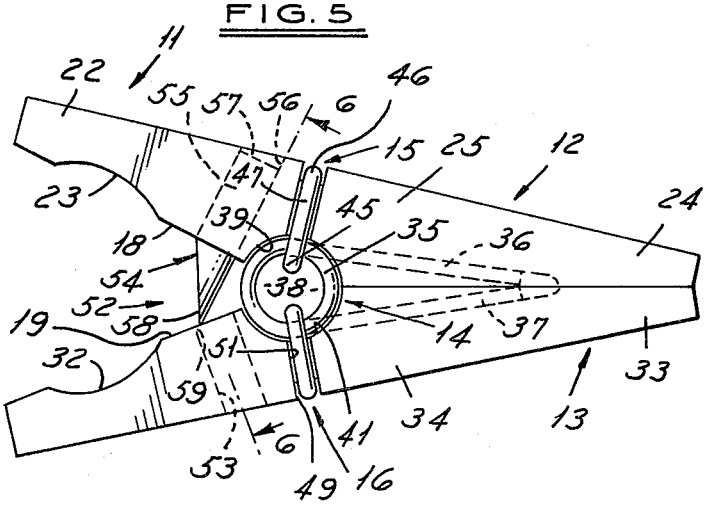

FIG. 7
PRIOR ART
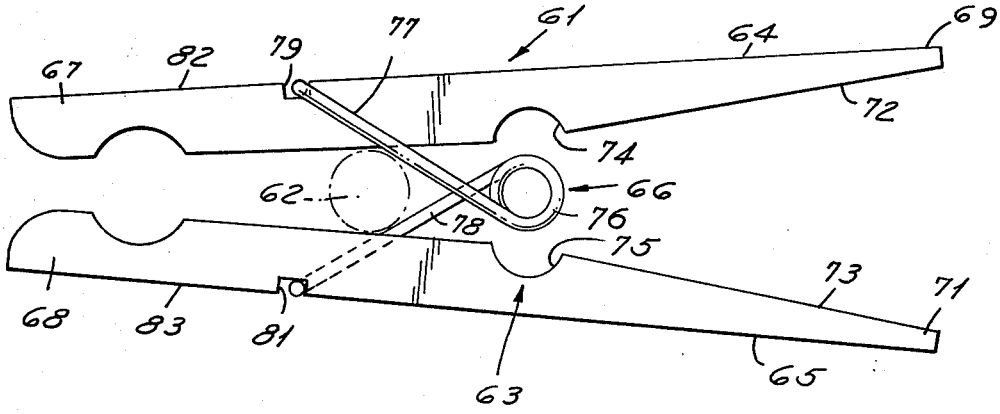
FIG. 8
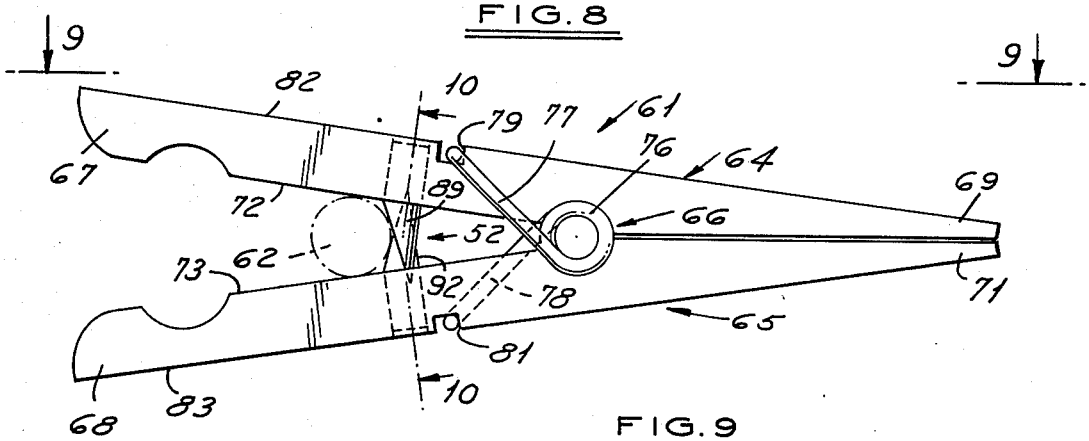
FIG. 9
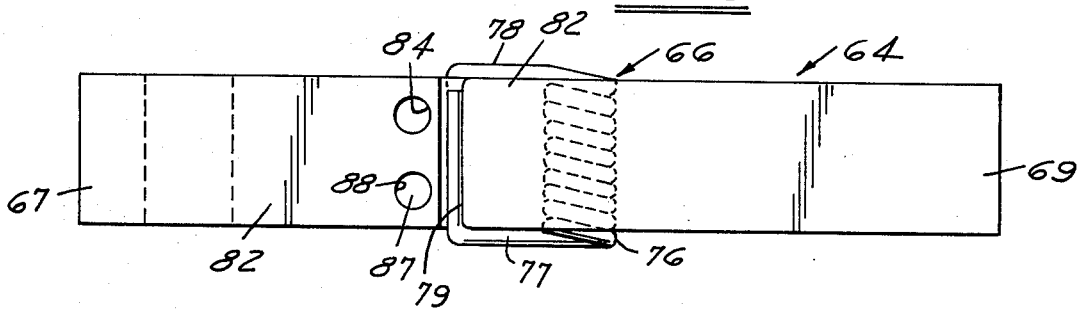
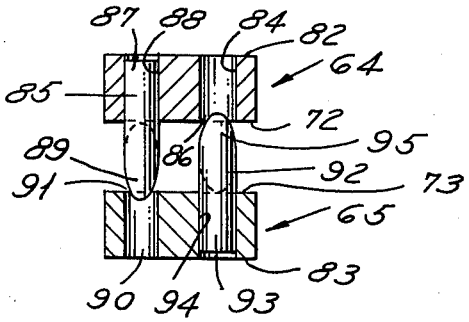
FIG. 10

CLOTHESPIN

BACKGROUND OF THE INVENTION

This invention relates to clothespins, and more particularly to highly stable spring-type clothespins which will not fall apart under abnormal conditions.

The prior art teaches many clothespins of the type having a pair of elongated clamping members and a spring interposed therebetween for normally urging the jaws of the clothespin closed upon one another. Many of the springs used in the prior art quickly lose their resiliency and render the closepin ineffective after a short period of use. Helical springs have proven to be extremely effective at providing a sufficient clamping force over an extended period of use.

However, many of the clothespins of the prior art utilizing helical springs are structurally unstable. If a clothesline or an article of clothing or the like is inserted between the jaws of the clothespin to a point sufficiently closed to the fulcrum, the body of the spring may lift out of the grooves provided therefore causing the clothespin to fall or fly apart if any type of lateral or longitudinal force is applied to its tail portion.

Some of the prior art attempts to solve this problem involve the use of sliding sheaths or staple arrangements whereby the spring is physically attached at one or more points to the two halves of the clothespin. This increases the complexity and cost of the clothespin so as to render many such proposed modifications to be economically unfeasible.

Furthermore, since most of the springs utilized in the prior art are metal, they are subject to rust. Therefore, the clothesline or any article of clothing or the like which is inserted between the jaws of the clothespin and allowed to physically contact the spring may become soiled or acquire a rust deposit often necessitating relaundering of the article.

The clothespin of the present invention provides a highly stable clothespin which overcomes the disadvantages of the prior art set forth hereinabove.

SUMMARY OF THE INVENTION

The clothespin of this invention comprises a pair of generally symmetrical, longitudinally elongated members each having a longitudinal axis and similarly configured inner and outer surface portions. Each of the pair of elongated members includes a forward clamping jaw having its inner surface portion adapted for gripping articles when the clamping jaw of one of the pair of members closes into clamping engagement with the corresponding clamping jaw of the other of the pair of members. Additionally, each of the members includes a tail adapted to be manually engaged for levering the forward clamping jaw open and an intermediate portion between the jaw and the tail for defining a fulcrum about which each of the pair of members may be pivoted for opening and closing the clamping jaws with respect to one another.

A spring means is provided for normally urging the clamping jaws toward one another. The spring means includes a coiled hollow body portion intermediate first and second elongated end portions. The intermediate portion of each of the pair of members includes a lateral groove across the inner surface portion thereof and each groove is generally perpendicular to the longitudinal axis of the member and has a generally semi-circular cross-sectional configuration such that the body portion of the spring means may be houseably received between the correspondingly opposed lateral grooves of the pair of elongated members. The intermediate portion of one of the pair of members has a first longitudinal recess in the inner surface portion thereof for receivably retaining the first end portion of the spring means and the intermediate portion of the other of the pair of members has a second longitudinal recess in the inner surface portion thereof for receivably retaining the second end portion of the spring means.

A first clip means is provided for retainably securing one of the pair of members to the hollow body portion of the spring means and a second clip means is provided for retainably securing the other of said pair of members to the hollow body portion of the spring means thereby preventing the inadvertent separation of the members and the spring means even under abnormal conditions.

In one embodiment of the present invention, each of the first and second clip means includes an integral piece of resilient material having an intermediate body portion adapted for operatively engaging one of the members and opposite clip ends adapted to be inserted into corresponding opposite ends of the hollow body portion of the spring means for retainably securing the member to the spring means.

The improved stability may also be obtained by providing aperture means in the inner surface portion of one of the pair of members forward of the lateral groove and a corresponding pin means extending from the inner surface portion of the other of the pair of members disposed forward of the lateral groove such that the pin means extends into and out of the aperture means as the forward clamping jaws are closed and opened so as to always prevent articles inserted between the jaws from contacting any portion of the spring means so as to prevent rust spots and the like from being deposited on the clothesline or the articles being hung thereon while simultaneously improving the stability of the clothespin.

In an alternate embodiment, laterally disposed pin and aperture combinations may be provided on each of the members and the pins may be tapered to insure sufficient clearance.

In still another embodiment of the present invention, a conventional spring-type clothespin may be modified by the addition of pin and aperture means disposed between the spring means and the jaws for preventing the clothes and the clothesline from contacting any portion of the metallic spring means thereby insuring that no rust marks are deposited on the clothes or the clothesline while simultaneously serving to improve the stability of the clothespin to prevent separation of the clamping members and the spring means.

Other advantages and meritorious features of the present invention will be more fully understood from the following description of the drawings and the preferred embodiments, the appended claims and the drawings which are described hereinbelow.

BRIEF DESCRIPTION OF THE DRAWINGS

FIG. 1 is a perspective view, partially broken away, of the high stability clothespin of the present invention;

FIG. 2 is a fragmentary side view of the clothespin of FIG. 1;

FIG. 3 is a perspective view of the spring means of the clothespin of FIG. 1;

FIG. 4 is a perspective view of one of the clip means utilized in the clothespin of FIG. 1;

FIG. 5 is a fragmentary side view of the clothespin of FIG. 1 modified to include the pin and aperture means of the present invention;

FIG. 6 is a sectional side view of the pin and aperture means of the clothespin of FIG. 5 taken along view lines 6—6 thereof;

FIG. 7 is a side view of a conventional spring type clothespin of the prior art in an unstable configuration due to the depth of insertion of the clothesline with respect to the fulcrum;

FIG. 8 is a side view, partially broken away, showing the conventional spring type clothespin of FIG. 7 modified to include the pin and aperture means of the present invention;

FIG. 9 is a top view of the modified clothespin of FIG. 8; and

FIG. 10 is a sectional side view of the pin and aperture means of FIG. 8 taken along view lines 10—10 thereof.

DESCRIPTION OF THE PREFERRED EMBODIMENTS

FIG. 1 shows the highly stable clothespin 11 of the preferred embodiment of the present invention. Clothespin 11 includes a pair of generally symmetrical, longitudinally elongated members 12, 13, a spring assembly 14 and a pair of spring-retaining clip elements 15, 16 for retainably securing the members 12, 13 to the spring assembly 14 even under abnormal conditions.

The elongated member 12 has a longitudinal axis 17, an inner surface portion 18, an outer surface portion 19, and a pair of side portions 21 which extend from the outer surface portion 19 to the inner surface portion 18. The elongated member 12 has a forward clamping jaw 22 having its inner surface portion 18 adapted for gripping articles, as by the inclusion of a lateral gripping configuration 23. The member 12 further includes a tail 24 adapted to be manually engaged for levering the forward clamping jaw 22 open and an intermediate portion 25 between the clamping jaw 22 and the tail 24 for defining a fulcrum 26.

The other elongated member 13 also has a longitudinal axis, not shown, and a similarly configured inner surface portion 27, outer surface portion 28, and side portions 29. The elongated member 13 has a forward clamping jaw 31 having its inner surface portion 27 adapted with a gripping configuration 32 such that articles inserted between the jaws 22, 31 may be positively gripped when the clamping jaw 22 closes into clamping engagement with respect to the corresponding clamping jaw 31.

Similarly, the second elongated member 13 includes a tail 33 adapted to be manually engaged for levering the forward clamping jaw 31 open and an intermediate portion 34 for defining the second half of the fulcrum 26 about which each of the pair of members 12, 13 may be pivoted for opening and closing the clamping jaws 22, 31 with respect to one another.

The spring assembly 14 of the clothespin of FIG. 1 is shown in detail in FIG. 3. The spring assembly 14 is conventionally made from spring metal and includes a coiled or helical hollow body portion 35 intermediate first and second elongated end portions 36, 37. The interior 38 of the hollow body portion 35 is open at both ends. FIG. 3 shows the spring assembly 14 in the relaxed position and the phantom lines show the spring as it is wound to the operative position with the elongated end portion 37 being parallel to and pointing in the same direction as the end portion 36 to provide the spring effect as conventionally known.

As shown in FIG. 1, the elongated members 12, 13 are mounted about a pivot or a fulcrum 26 such that the inner surface portion 18 of the member 12 is disposed opposite and facing the corresponding inner surface portion 27 of the other elongated member 13. Each of the intermediate portions 25, 34 of the members 12, 13 are provided with a lateral groove 39, 41 across the inner surface portion 18, 27 thereof. The grooves 39, 41 are generally perpendicular to the longitudinal axis 17 and have a generally semi-circular cross-sectional configuration such that the body portion 35 of the spring assembly 14 may be houseably received between and at least partially within the corresponding opposed lateral grooves 39, 41 of the pair of elongated members 12, 13.

When the body portion 35 of the spring assembly 14 is placed in the lateral groove 41 of the member 13 and the lateral groove 39 of the member 12 is placed over the upper portion of the spring body 35 such that the inner surface portions 18, 27 are disposed facing one another and the jaws 22, 31 are opposite one another, then the body 35 of the spring assembly 14 serves as the fulcrum 26 about which the members 12, 13 may be pivoted to open and close the jaws 22, 31 with respect to one another.

The intermediate portion 25 of the first elongated member 12 may have its inner surface portion 18 provided with a first longitudinal recess or slot 42 into which the first elongated end portion 36 of the spring assembly 14 may be concealably and receivably retained. Similarly, the intermediate portion 34 of the second elongated member 13 may have its inner surface portion 27 provided with a second longitudinal recess 43 for concealably and retainably receiving the opposite elongated end portion 37 of the spring assembly 14 so that the spring assembly 14 is operatively mounted with respect to the members 12, 13 and normally urges the jaws 22, 31 toward one another or toward the "closed" position.

The resilient clip elements 15 and 16 are adapted to retainably secure the pair of elongated members 12, 13 to the hollow body portion 35 of the spring assembly 14 to prevent inadvertent separation. Both of the clip elements 15 and 16 are identical in the preferred embodiment of the present invention and both may be represented by the description of the clip element 15 shown in FIG. 4. The clip element 15 includes an intermediate body portion 44 adapted for operatively engaging one of the pair of elongated members 12, 13 about its intermediate portion 25, 34 and a pair of opposite clip ends 45 adapted to be inserted into the corresponding opposite ends of the hollow interior 38 of the body portion 35 of the spring assembly 14.

In the preferred embodiment, the clip elements 15, 16 are generally configured as a partially opened rectangle once they are installed in operative position on the clothespin as shown in FIGS. 1 and 4. The intermediate body portion 44 of the clip 15 includes a clip top 46 the length of which is approximately equal to the lateral width of the intermediate portion 25 of the member 12 measured perpendicular to the longitudinal axis 17 and across the outer surface portion 19 thereof. Furthermore, the intermediate body portion 44 of the clip 15 includes a pair of relatively straight clip sides 47 distending from the opposite ends of the clip top 46. Once installed, the clip sides 47 are perpendicular to the clip top 46, parallel with one another, and approximately equal in length to the thickness of the intermediate portion 25 of the member 12 measured along the side 21 between the outer surface portion 19 and the inner surface portion 18 thereof.

The clip ends 45 are relatively straight and disposed facing one another so as to be generally perpendicular to the clip sides 47 when installed in operative position and parallel to the clip top 46 so as to at least partially form the partially opened bottom length of the rectangular configuration of the clip element 15 as shown in FIG. 4.

The intermediate portions 25, 34 of the pair of elongated elements 12, 13 are each provided with a similar lateral recess 48. Each of the continuous lateral recesses 48 includes a top recess 49 across the outer surface portion 19, 28 and a pair of parallel side recesses 51 extending along the sides 21, 29 from the opposite ends of the top recess 49 to the opposite ends of the lateral grooves 39, 41. The lateral recesses 48 are adapted to concealably receive and operatively retain the top 46 and sides 47 of the clip elements 15, 16 so that when the end portions 45 of the clips 15, 16 are inserted into the opposite ends of the hollow interior 38 of the body portion 35 of the spring assembly 14, the elements 12, 13 will be retainably secured to the spring assembly 14 as previously described.

In operation, the lateral grooves 39, 41 of the two members 12, 13 are placed on opposite sides of the body portion 35 of the spring assembly 14 and the ends 36, 37 of the spring assembly 14 are operatively inserted into the longitudinal recesses 42, 43. The clip elements 15, 16 are then placed in the lateral recesses 48 and the ends 45 of the clip elements 15, 16, which were previously separated or pulled apart from one another as illustrated by the phantom lines in FIG. 4, are inserted into the opposite ends of the hollow interior 38 of the body portion 35 of the spring assembly 14 and pressed together to form the rectangular configuration and positively retain the elements 12, 13 with respect to the spring assembly 14.

The embodiment of the clothespin 11 shown in FIG. 5 is an alternate embodiment of that shown in FIG. 1 and further includes the pin and aperture assembly 52 of the present invention. The pin and aperture assembly 52 illustrated in FIGS. 5 and 6 includes an aperture 53 formed in or through the inner surface portion 27 of the intermediate portion 34 of the elongated member 13 and an elongated pin element 54 which extends from the inner surface portion 18 of the intermediate portion 25 of the member 12. The pin element 54 has a generally cylindrical body portion 55 which may be forced-fitted or otherwise secured within an aperture 56 formed in or through the inner surface portion 18 of the intermediate portion 25 of the member 12 such that the butt end 57 of the body 55 of the pin 54 is level with or recessed from the outer surface portion 19 of the element 12. The pin 54 also includes a tapered head or tip 58 which extends from the inner surface portion 18 of the element 12 toward the opening 59 of the aperture 53 through the inner surface portion 27 of the member 13. The length of the pin element 54 is such that the tapered tip 58 of the pin 54 extends immediately adjacent to the opening 59 of the aperture 53 when the jaws 22, 31 are fully opened and is adapted to be telescopically received into and out of the aperture 53 as the jaws 22, 31 are opened and closed with respect to one another.

The pin and aperture assembly 52 of FIGS. 5 and 6 insures that the pin 54 is always interposed between any article inserted between the jaws 22, 31 of the clothespin 11 and the spring assembly 14 so that neither the clothesline nor any of the articles inserted between the jaws 22, 31 can contact the spring assembly 14 so as to pick up rust spots or the like while simultaneously increasing the stability of the clothespin by increasing its resistance to separation due to lateral and/or longitudinal movement of the jaws 22, 31 or the tails 24, 33 of the members 12, 13.

FIG. 7 shows a conventional spring-type clothespin 61 which has achieved a highly unstable condition due to the fact that a clothesline 62 has been inserted too far towards the fulcrum 63. The conventional clothespin 61 includes a pair of elongated clamping members 64, 65 having a spring assembly 66 interposed therebetween. Each of the members 64, 65 has a front portion 67, 68 adapted to serve as jaws for gripping a clothesline and articles of clothing inserted therebetween. Both the members 12, 13 and the members 64, 65 are generally non-metallic while the spring assemblies 14, and 66 are generally metallic. Typically, wood or plastic are used for the elongated elements 12, 13, 64, and 65. Each of the members 64, 65 has a tail 69, 71 adapted to be manually engaged to overcome the force of the spring means 66 for opening the jaws 67, 68 with respect to one another to enable the clothesline and the articles to be received therebetween.

In FIG. 7, it will be seen that the inner surface portions 72, 73 of the members 64, 65 have been provided with lateral grooves 74, 75 which are adapted to receive the hollow coiled body portion 76 of the spring assembly 66 while the ends 77, 78 of the spring assembly 66 are retainably anchored in lateral recesses 79, 81 formed in the outer surface portion 82, 83 of the members 64, 65.

Typically, when the clothesline 62 or some article of clothing or the like is inserted between the jaws 67, 68 to a point such as shown in FIG. 7 which is too close to the body portion 76 of the spring 66 which forms the fulcrum of the clothespin 61, the closure of the spring legs 77, 78 upon the clothesline 62 will cause the body 76 of the spring assembly 66 to rise up out of the lateral grooves 74, 75 creating a highly unstable situation in which any type of lateral pressure and possibly even longtitudinal pressures to the tails 69, 71 may cause the members 64, 65 to literally fly apart with the resultant destruction of the useful life of the clothespin 61.

As shown in FIGS. 8–10, the stability of the conventional spring-type clothespin 61 of FIG. 7 may be improved by modifying the clothespin 61 to include the pin and aperture assembly 52 of the present invention which not only improves stability but simultaneously prevents the articles inserted between the jaws 67, 68 from physically contacting any part of the spring assembly 66.

The pin and aperture assembly 52 shown in FIGS. 8–10 includes a first aperture or recess 84 in and/or through the inner surface portion 72 of the member 64 and a first elongated pin element 85 protruding from the inner surface 72 of the first member 64. The first recess 84 and the first pin 85 are laterally displaced from one another across the interior surface 72 of the member 64 and are generally perpendicular to the longitudinal axis thereof. The first recess 84 has an opening 86 in the inner surface portion 72 thereof while the pin 85 includes a body portion 87 which is force-fitted or otherwise secured within an aperture 88 in or through the inner surface 72 and a tapered tip 89 which extends away from the surface 72 toward the inner surface 73 of the member 65.

Similarly, the member 65 is provided with a second aperture or recess 90 having an opening 91 in the inner surface portion 73 thereof and a second elongated pin 92 which extends beyond the surface 73 toward the inner surface 72 of the member 64. The second recess 90 and pin 92 are laterally spaced from one another and disposed so that the second recess 90 and the second pin 92 are directly opposite the first pin 85 and recess 84, respectively. The pin 92 has a body portion 93 which is force-fitted or otherwise conventionally secured within a recess or aperture 94 into or through the inner surface portion 73 of the member 65 and a tapered head portion 95 which extends away from the surface 73 and toward the inner surface portion 72 of the member 64.

In operation, the tapered tip 89 of the first pin 85 of the member 64 is disposed immediately adjacent to the opening 91 of the second recess 90 of the member 65 and the tapered tip 95 of the pin 92 of the member 65 is disposed immediately adjacent to the opening 86 of the first aperture 84 of the member 64 when the jaws 67, 68 are in their fully opened position. The orientation of the pins 85, 92, the apertures 84 and 90, and the taper of the tips 89, 95 are such that the tips 89, 95 may be telescopically received into and out of the apertures 90, 84 as the jaws 67, 68 are opened and closed with out interference.

This arrangement, not only prevents rust spots and the like from being deposited on the clothesline or articles inserted between the jaws 67, 68 but simultaneously improves the stability of the clothespin 61 and prevents the unstable condition illustrated in FIG. 7 from occurring as shown in FIG. 8 which illustrates that the clothesline 62 will be blocked by the pins 85, 93 from being inserted to a point at which instability can result. Additionally, if at least the tips 89, 95 of the pins 85, 92 extend at least partially into the apertures 90, 94 during normal use, then lateral and longitudinal stability are greatly improved.

With this detailed description of the specific structure used to illustrate the preferred embodiments of the present invention and the operation thereof, it will be obvious to those skilled in the art that various modifications can be made in both the shape and structure of the clips 15, 16 and in the arrangement, structure and number of pins and apertures employed in the pin and aperture assembly 52 without departing from the spirit and scope of the invention which is limited only by the appended claims.

I claim:

1. A clothespin comprising a pair of generally symmetrical, longitudinally, elongated, generally rectangular, block-like non-metallic members each having a longitudinal axis and similarly configured inner and outer surface portions; each of said pair of elongated members including a forward clamping jaw having its inner surface portion adapted for gripping a clothesline and articles to be hangably suspended therefrom when the clamping jaw of one of said pair of members closes into clamping engagement with the corresponding clamping jaw of the other of said pair of members, a tapered tail adapted to be manually engaged for levering said forward clamping jaws open, and an intermediate portion between said jaw and said tail for defining a fulcrum about which each of said pair of members may be pivoted for opening and closing said clamping jaws with respect to one another; metal spring means for normally urging said clamping jaws toward one another in a clamping position, said spring means including a coiled hollow body portion intermediate first and second relatively straight elongated end portions; the intermediate portion of each of said pair of members including a transverse lateral groove across the inner surface portion thereof, said groove being generally perpendicular to said longitudinal axis and having a generally semi-circular cross-sectional configuration such that the coiled hollow body portion of said spring means may be houseably received between the correspondingly opposed lateral grooves in the inner surface portions of said pair of elongated members and at least partially concealed therein, the intermediate portion and tail of one of said pair of members having a first relatively straight longitudinal recess in the inner surface portion thereof for receivably retaining and recessably concealing said first relatively straight elongated end portion of said spring means and the intermediate portion and tail of the other of said pair of members having a second relatively straight longitudinal recess in the inner surface portion thereof for receivably retaining and recessably concealing said second relatively straight elongated end portion of said spring means so that the end portions of said spring means are recessed beneath said inner surface portions and said coiled body portion is at least partially recessed to prevent or at least minimize metal contact with said clothesline and said suspended articles, a first metal clip means for retainably securing one of said pair of members to the coiled hollow body portion of said spring means and a second metal clip means for retainably securing the other of said pair of members to the coiled hollow body portion of said spring means so as to prevent the inadvertent separation of said members and said spring means even under abnormal conditions, each of said members including a three-sided continuous slot formed in the external surfaces of the intermediate portion thereof and extending from one end of said lateral groove in the inner surface portion along one side of said intermediate portion, laterally across the outer surface portion of said intermediate portion directly opposite said lateral groove and along the opposite side of said intermediate surface to the opposite end of said lateral groove, the outer surface slot portion being generally parallel to said lateral groove and perpendicular to said longitudinal axis and said side slots being generally perpendicular to said lateral groove; each of said clip means being an integral piece of resilient metallic material generally configured as a partially opened rectangle when in operative position, said clip means having a relatively straight intermediate clip body, a pair of relatively straight clip sides which are generally perpendicular to said clip body and a pair of clip ends disposed toward one another and generally parallel to said clip body and perpendicular to said clip sides, said body portion being adapted to be receivably retained and recessably concealed within said outer surface slot portion, said clip sides being adapted to be receivably retained and recessably concealed within said slot sides, and said clip ends adapted to be insertably received and retained within the opposite hollow ends of said coiled spring body thereby preventing separation while simultaneously recessing said metal clip means beneath the exterior side and outer surface portions of said members to prevent or at least minimize metal contact with said clothesline and the articles suspended therefrom to prevent rust spots and the like.

2. The clothespin of claim 1 further including aperture means in the inner surface portion of one of said pair of members and disposed forward of said lateral groove and pin means extending from the inner surface portion of the other of said pair of members and disposed forward of said lateral groove, said pin means comprising geneally cylindrical elongated pin extending into and out of said aperture means as said forward clamping jaws are closed and opened so as to always prevent articles inserted between said jaws from contacting any portion of said spring means thereby preventing rust spots and the like from being deposited on the clothesline or the articles being hung thereon.

3. The clothespin of claim 2 wherein said other of said pair of members having said pin means extending from the inner surface portion thereof includes an aperture in the inner surface portion disposed forward of said groove, a generally cylindrical elongated pin having a body portion and a tapered tip, said body portion being retainably received within said aperture such that said tapered tip extends toward said inner surface portion of said one of said pair of members; wherein said aperture means of said one of said members is a recess adapted to receive the tapered tip of said pin; and wherein both said pin and said recess are disposed on the longitudinal axes of said pair of members equidistant between the sides thereof.

4. The clothespin of claim 1 further including a first recess and a first generally cylindrical elongated pin laterally disposed across the inner surface portion of one of said pair of members adjacent to and forward of said groove, a second recess and a second generally cylindrical elongated pin laterally disposed across the inner surface portion of the other of said pair of members adjacent to and forward of said groove, said first pin being disposed over said second recess and said second pin over said first recess such that said pins travel into and out of said recesses as said clamping jaws are closed and opened so as to always prevent any article inserted into said jaws from contacting said spring means.

5. In an improved spring-type clothespin having first and second clamping members and a spring means interposed therebetween, said members having front portions whose opposed inner surfaces are adapted to serve as clamping jaws for gripping clothes and a clothesline therebetween, said spring means being metallic and susceptable to rusting and being disposed between said members to serve as a fulcrum for normally urging said jaws toward one another in a clamping position, said members being non-metallic and not susceptable to rust and having tail portions adapted to be manually engaged to overcome the force of said spring means for opening said jaws to enable said clothes and said clothesline to be clampably received therebetween, the improvement comprising pin and aperture means disposed between said spring means and said jaws for preventing said clothes and said clothesline from contacting any portion of said metallic spring means thereby insuring that no rust spots are received on said clothes or said clothesline while simultaneously serving to improve the stability of the clothespin to prevent separation of the clamping members and the spring means, said pin and aperture means including at least one pin having a generally circular cross-section permanently positioned and secured in an aperture in the inner surface of one of said clamping members intermediate said clamping jaw and said spring means, said pin having an elongated body portion extending beyond said inner surface and generally perpendicular thereto, the other of said clamping members including a cylindrical aperture through the inner surface thereof intermediate said clamping jaw and said spring means for telescopically receiving said elongated body portion of said pin being tapered and having the tapered face disposed toward said clamping jaws to insure sufficient clearance as said elongated body portion is moved in and out of said cylindrical aperture, said elongated body portion of said pin being effective even when said jaws are fully opened to prevent said clothes or said clothesline from contacting said spring means so as to avoid rust spots, tears, and the like.

* * * * *